United States Patent [19]

Sugawara

[11] 4,082,539

[45] Apr. 4, 1978

[54] METHOD FOR THE PRELIMINARY TREATMENT OF MATERIALS FOR SINTERING

[75] Inventor: Kinichi Sugawara, Kitakyushu, Japan

[73] Assignee: Nippon Steel Corporation, Tokyo, Japan

[21] Appl. No.: 672,789

[22] Filed: Apr. 1, 1976

[30] Foreign Application Priority Data

Apr. 2, 1975 Japan ..... 50-39215

[51] Int. Cl.[2] ..... C22B 1/14

[52] U.S. Cl. ..... 75/3; 75/5; 23/313 R; 264/117

[58] Field of Search ..... 75/3, 4, 5; 23/313 R; 264/117

[56] References Cited

U.S. PATENT DOCUMENTS

| | | | |
|---|---|---|---|
| 3,489,549 | 1/1970 | Jomoto et al. | 75/5 |
| 3,689,249 | 9/1972 | Judd | 75/3 |

FOREIGN PATENT DOCUMENTS

| | | |
|---|---|---|
| 48-25281 | 7/1973 | Japan. |

*Primary Examiner*—R. Dean
*Assistant Examiner*—Michael L. Lewis
*Attorney, Agent, or Firm*—Watson, Leavenworth, Kelton & Taggart

[57] ABSTRACT

A new method for the preliminary treatment of the raw materials used for sintering of powdery iron ore is provided, in which the hydrophilic binder is dividedly incorporated in a first treatment step and/or a second treatment step. The solid carbon is also dividedly incorporated. The high productivity and quality of the product can thus be maintained and also the NOx conversion rate can be largely decreased.

13 Claims, 6 Drawing Figures

METHOD FOR THE PRELIMINARY TREATMENT OF MATERIALS FOR SINTERING

DETAILED DESCRIPTION OF THE INVENTION

Figure 1:
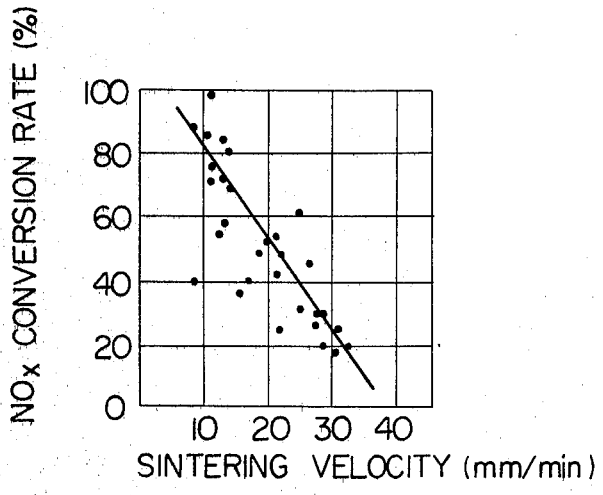
Figure 1:
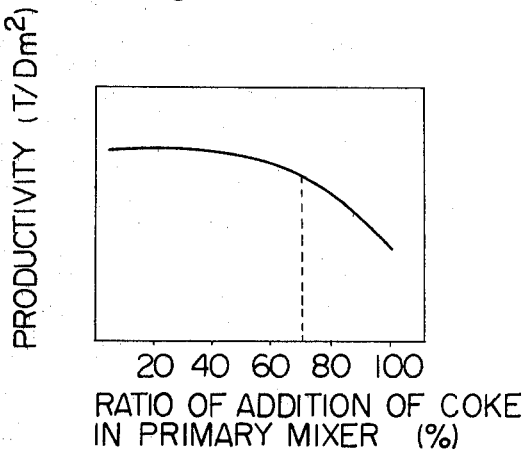

This invention relates to a method for the preliminary treatment of materials for sintering in which the materials for sintering are preliminarily mixed, subjected to moisture adjustment and pelletized before a powdery ore is sintered.

In order to provide against environmental pollution, it has recently been strongly desired to use, as one of the materials for sintering, a converter dust, a blast furnace dust or other fine dusts containing a great deal of iron value which are collected in an iron-making plant, and also from the view point of ore resources, to use, even as a powdery ore, an ore of a kind containing a higher percentage of fine powder.

However, the materials for sintering having a relatively more fine powder is poor in the degree of ventilation or air-penetration, and accordingly, the productivity and quality of a sintered ore obtained therefrom will become much poorer than in other cases.

One way of treating fine powdery materials for sintering to achieve such end as is stated above is described in a Japanese patent No. 720128 (Japanese patent publication No. 25281/73).

This patented invention relates to a method for preliminarily treating the materials for sintering which comprises a first treatment step and a second treatment step, said first step involving adding a part of the total solid carbon to be added to the materials for sintering, which is then subjected to mixing, moisture-adjusting and pelletizing in a mixer, and said second step involving adding the remaining part of the total solid carbon to be added to the resulting mixture obtained in the first step, which is then subjected to mixing, moisture-adjusting and pelletizing in a mixer. Accordingly, it relates to a method for preliminarily mixing, moisture-adjusting and pelletizing the materials for sintering before the powdery ore is sintered, which results in improving the productivity as compared with the older method. This patented method may be named as the coke-divided-addition method, since the coke or coke breeze is often used as the solid carbon.

However, in order to fully display the effect of this patented invention, it is necessary that the materials for sintering should be sufficiently pseudo-granulated in the first step of the so-called coke-divided-addition method. If it is not sufficient, its productivity will be much the same as that of the known older method wherein a total amount of the solid carbon such as coke breeze is added at one time.

Consequently, in case of the sintering in which a lot of fine powder material are used, a good or bad way of making pseudo particles or pseudo granulation of such sintering materials exerts either full or insufficient effect. As a matter of fact, it is not easy to fully conduct pseudo granulation of the materials for sintering containing much fine powder material.

The result of practical operations shows that, when the fine powder of less than 125 $\mu$ exists in the total materials in the ratio of 15 to 35%, the pseudo granulation can not fully be conducted even if they are mixed in a drum mixer for more than 6 minutes. In fact, the pseudo granulation does not progress because of saturation even if mixing is conducted longer than a certain period. Moreover, a drum mixer capable of mixing materials for a long time must be constructed at high cost. Thus, a drum mixer with a mixing time of 5 to 7 minutes has practically been used.

It is, therefore, the first object of this invention to provide a method for the preliminary treatment of materials for sintering in which a high productivity and quality can be maintained even when such fine powdery material for sintering, that is, one containing fine powder of less than 125 $\mu$ in the ratio of 15 to 35% is used for sintering.

In a method of sintering the iron ore, the nitrogen which is contained in the coke in about 1% is usually converted in about 40% thereof into NOx. It is known that it occupies a substantial part (about 90%) of the NOx generated in the course of sintering. It is also known that the conversion rate to NOx of the nitrogen in the coke may vary in the range between 20% and 60% according to the sintering conditions. It is, however, unknown what factor causes a change of conversion rate to NOx.

According to the results of our various studies about the relation between the factors for sintering and the NOx, it has been found that the sintering velocity in the course of sintering, that is, the combustion velocity of the coke and the conversion rate to NOx are in the inversely proportional relation. This relation is shown in FIG. 1. In FIG. 1, various materials having different particle sizes are used for sintering, and the amount of NOx in the exhaust gas is measured to give the conversion rate to NOx of the N in the coke whereby the relation between this NOx conversion rate and the sintering velocity is plotted. From FIG. 1, it is seen that both are in the relation of substantially straight line. In other words, it is clear that the conversion rate to NOx of the N in the coke in the course of sintering can be decreased by increasing the sintering velocity.

In the sintering process, a great many factors exists and it is thus very difficult to simply pick up a factor which governs the sintering velocity. However, it can be said that some of the most influential factors are (1) the degree of ventilation or penetration of air in the material layers and (2) the condition for inflammability of the coke.

The degree of ventilation in the material layers can be substantially determined by (a) the distribution of the particle size of the so-called pseudo particles and (b) the condition of filling or packing of the particles charged into a sintering machine, while the inflammability of the coke is substantially governed by the condition of supply of air to the coke particles. In passing, the aforesaid pseudo particles may be formed as follows.

The materials for sintering are subjected to mixing, moisture-adjustment and granulation by rolling so that fine powdery particles will stick to the circumference of coarse particles, or only fine powdery particles will mutually aggregate, with the result of formation of the pseudo particles.

The above two factors (1) and (2) may have some corelation with each other but there is no complete subordinate relation therebetween. If the distribution of the particle size of the pseudo particles is made better by improving the distribution of the particle size of the materials or by strengthening the formation of the pseudo particles by the use of hydrophilic binders or the strong rolling in the mixer, the degree of ventilation in the course of sintering is improved so as to promote combustion of the coke and increase the sintering velocity. On the other hand, however, in the course of formation of the pseudo particles, the coase particles of the coke may become nuclei, around which fine powdery ore sticks, or the fine particles of the coke may be embedded in the layer of fine powdery ore, which constitutes also the sticking layer of the pseudo particles. As a result, even if the formation of the pseudo particles becomes better so that the degree of ventilation through the material layer may be improved, the flammability of the coke becomes lowered so that the sintering velocity can not be promoted.

For the above reasons, the strengthening of formation of pseudo particles and the improvement of inflammability of the coke are quite inconsistent with each other.

It is, therefore, the second object of the invention to provide a method for the preliminary treatment of materials for sintering in which the amount of NOx in the exhaust gas can be decreased as well as the sintering velocity can be increased.

For the purpose of accomplishing the first object of the invention, it has now been found that an advantageous result can be obtained if a mini-pellet is incorporated into the pure materials for sintering in an amount of 3.0% or more in the coke-divided-addition method.

In view of a limited capacity of a drum mixer for pseudo granulation, it is clearly effective for pseudo granulation to convert the fine powdery material into the mini-pellet as much as possible so that the materials to be charged into the drum mixer may have as small a percentage of fine powdery material as possible.

Our experience shows that if the mini-pellet is incorporated in the pure materials in an amount of 3.0% or more, it will not contribute to the enhancement of productivity because of the defects of the mini-pellet hereinafter mentioned. If the amount is 10% or more, even a minus effect will appear. Accordingly, the mini-pellet has conventionally been used in an amount less than 3%. However, it has been found that if the coke-divided-addition method is carried out, the above defect can be overcome and that the mini-pellet can thus be mixed in the pure materials in an amount as much as 3.0% or more.

In the coke-divided-addition method, the distribution of the solid carbon added to the mixed materials consists roughly of those which stick to the outside of the particles so that they may contact easily with air and those which is embedded inside the particles so that they will hardly be inflammable. The former solid carbon burns even under the condition that the partial pressure of oxygen is low, that is, it burns rapidly in the front part of the combustion zone. The temperature of this zone is not so high enough to melt the materials but is high enough to evaporate the water value and to effect the thermal decomposition of the lime in such particles as the mini-pellet which has a high percentage of water inside so that the water is difficult to evaporate and so that the thermal decomposition of the lime is also difficult to occur. The preliminary heating is thus conducted satisfactorily in the front part of the combustion zone. In the rear part of the combustion zone, the solid carbon contained inside the particles is caused to burn, which results in complete sintering.

Contrary to this, in a known older method wherein all the solid carbon is added once or only at one time, the evaporation of the water and the thermal decomposition of the lime in the mini-pellet is considerably delayed as compared with the other materials, with the result that only the mini-pellet portion will be subjected to poor sintering. The coke-divided-addition method can prevent this defect.

This invention is based upon the above finding, in which the solid carbon is incorporated into the materials in portionwise while only the materials containing a lot of fine powder is selected from the materials for sintering and mini-pelletized whereby the materials containing little fine powder is subjected to mixing, moisture-adjustment and pseudo granulation in a mixer or pelletizer. Thus, according to this invention, there is provided a method for the preliminary treatment of materials for sintering, including a step of mixing and moisture-adjusting said material for sintering in a mixer or a pelletizer, etc., which comprises (A) a first treatment step wherein (a) a part of the solid carbon to be mixed is added either to the materials for sintering consisting of a powdery or fine powdery ore and a lime stone or other additives or to said materials to which at least one kind of such sintering materials as a return fine or blast furnace dust, etc. has additionally been added, and (b) mixing and moisture-adjustment are effected and (B) a second treatment step wherein (a) mini-pellets containing particles of 1 – 7 mm size in an amount of at least 75% are added to the pure materials for sintering in an amount of 3 to 15% thereof and (b) the remaining amount of solid carbon is mixed so as to effect mixing, moisture-adjustment and granulation. It is preferable that said mini-pellet is made by incorporating 1 to 5% of hydrophilic binder.

Figure 2:
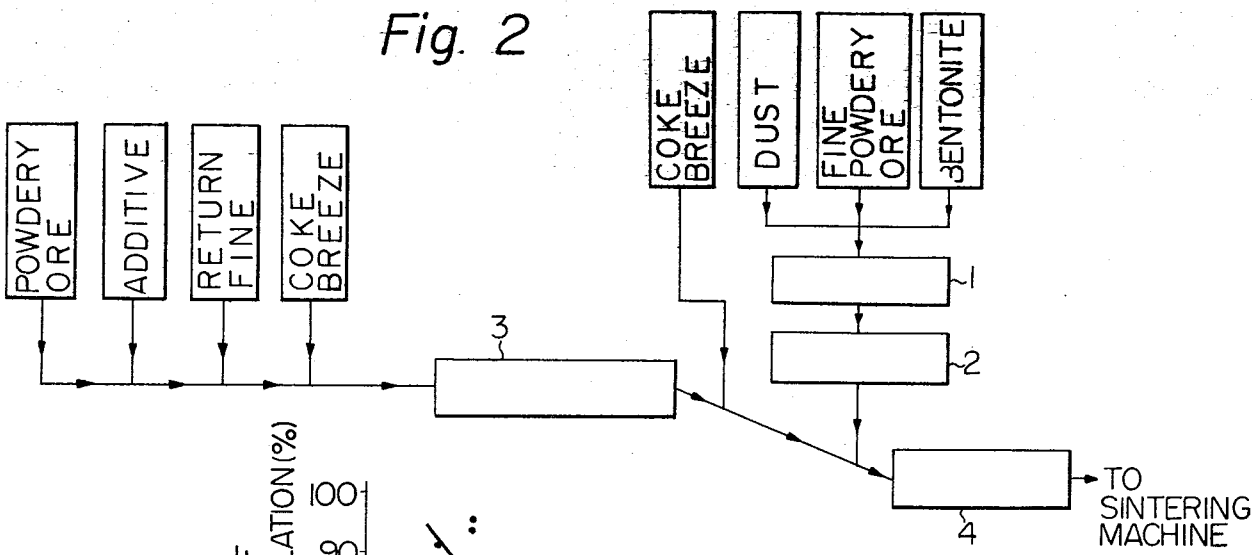
Figure 3:
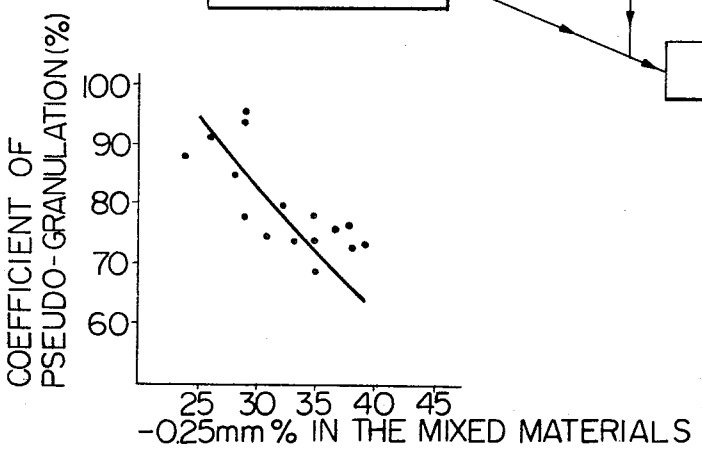

A preferable embodiment of this method is further described with respect to a flow sheet of FIG. 2 and an experimental data of FIG. 3.

A dust which has been generated and collected in an iron-making plant and a fine powdery ore, to which bentonite has been added, are mixed and moisture-adjusted in a mixer 1. The resulting materials are granulated or mini-pelletized in a pelletizer 2 to produce particles of 1 – 7 mm size. As this fine powdery ore, an iron ore which has been subjected to magnetic dressing is used. The mini-pelletized materials occupy 3 to 15% of the pure materials. What is meant by the pure materials is the entire materials to be charged into a sintering machine but excluding the return fine, coke breeze and hearth layer.

The remaining powdery ore, a part of the total amount of coke breeze, such additives as lime stone, silica, etc. and the return fine are subjected to mixing, moisture-adjustment and pseudo-granulation in a primary drum mixer 3 for about 6 minutes.

In this method, it is very significant to preferentially or selectively mini-pelletize the fine powdery materials. The pseudo-granulation of the materials for sintering containing particles of various sizes will proceed more easily as the percentage of the fine powder becomes smaller. It will also proceed more easily as the percentage of the proper particles of 1 – 3 mm size around which the fine powder sticks becomes larger. It there is too much fine powder, the pseudo-granulation is difficult to occur.

This tendency is clearly shown in FIG. 3. The coefficient of pseudo-granulation herein used means the ratio in which the fine powders of 250 $\mu$ or less has been pseudo-granulated. Accordingly, it will promote the efficiency of pseudo-granulation to decrease the amount of fine powder.

Consequently, if the mixing ratio of the mini-pellets is so low as 1 to 3%, the effect is too low to promote the efficiency of pseudo-granulation in the mixer 3. In this case, the productivity will be much the same as in the case of the coke-divided-addition method without the use of the mini-pellet. On the other hand, if the mini-pellets are mixed in more than 15%, our experiments show that even the adverse effect will be given to the productivity and the quality. This is why the use of the mini-pellets is limited to a range of 3 to 15%.

The pseudo-granulated particles contain inside a suitable amount of coke breeze. Also the mini-pellets contain inside a solid carbon of blast furnace dust.

The mini-pellets thus obtained and the materials which have been subjected to the pseudo-granulation are added with the remaining amount of the coke breeze, and the resulting materials are incorporated in the secondary drum mixer 4 for mixing, moisture-adjustment and pseudo-granulation.

The resulting mini-pellets and the pseudo-granulated particles have a suitable amount of the coke breeze attached to the circumference thereof, where coke breeze is under uniformly mixed condition.

On the other hand, the particle size of the mini-pellets should preferably be small if it is desired to promote the evaporation of the water value and the thermal decomposition of the lime contained in the mini-pellets, while the particle size of the mini-pellets should preferably be 2 mm or more in view of the enhancement of ventilation. It is ideal to provide the particle size of the mini-pellets of 2 to 5 mm, although it is practically difficult.

When the materials for the mini-pellets are predominantly of the particle size of less than 44 $\mu$, it is easy to arrange the mini-pellet particles of 2 to 5 mm size. However, such materials for the mini-pellets are limited in their available amount, and it is thus inevitable to use the materials for mini-pellets having poor granulation ability if the mini-pellets must be used in a great amount. Thus, when it is desired to granulate or pelletize such materials for mini-pellets into the particle size of more than 2 mm, the mini-pellets of a size of more than 5 mm will be generated in a considerable amount. Accordingly, there is a problem as to what degree of the mini-pellet particle size will or will not affect the quality of the product after the mini-pellet is sintered. In the practice of this invention, it has been found that the mini-pellets of the particle size less than 7 mm have fully been sintered. Generally, the mini-pellets of such small size as 1 - 3 mm have weak strength so that they are apt to return to the fine powder. However, in this invention, such mini-pellets are added just before the secondary drum mixer 4, and it has now been demonstrated that even such weak mini-pellets can fully be pseudo-granulated, which contributes to the enhancement of the ventilation. In this invention, the particle size of the mini-pellets should lie in the range of 1 to 7 mm as far as possible, such that at least 75% thereof will occupy that range. In the examples hereinafter described, it is seen that a satisfactory effect can be obtained when the percentage is between 75% and 85% average 80%.

In order to accomplish the second object of this invention, I have developed a method of strengthening the formation of pseudo particles as well as enhancing the inflammability of the coke.

There are three aspects of this invention for accomplishing this object, which are described below.

According to the first aspect of this method of the invention, there is provided a method for the preliminary treatment of materials for sintering, which comprises the steps of (1) mixing, moisture-adjusting and pseudo-granulating an ore with or without addition of a coke thereto, said coke being in an amount of less than 70% of the total amount to be added, (2) adding the whole or remaining amount of coke at one time or more times, said coke being under the condition that it has preliminarily contained water value or that it has been added with a hydrophilic binder, and (3) effecting mixing and pseudo-granulation.

Generally, in the operation of the pseudo-granulation of the materials for sintering, for the purpose of obviating the causes for lowering the inflammability of the coke, such as sticking of the powdery ore to the coarse coke particles or embedding of the coke breeze into the layer of powdery ore, it is considered appropriate to first effect the pseudo-granulation using only the ore excluding the coke breeze and thereafter add the usual dry coke breeze to effect mixing. However, when such step is simply carried out, the result of sintering becomes poor, which will contradict to the original object.

The reason is that, since the coke breeze has a wide distribution from the fine particles to the coarse particles, the fine particles having larger specific surface area will burn first, if they are allowed to burn as they stand. As a result, the convergence of heat does not occur, which gives rise to the lowering of the yield of the product.

In order to avoid this phenomenon, it is suitable to delay the combustion of the coke breeze to such a degree as that of the medium or coarse particles. It can practically be done by the step as follows:

In the primary mixer, only the ore or the ore plus the coke in an amount of less than 70% of the total amount of coke (it includes the coke value in the blast furnace dust or ash, etc.) are subjected to the pseudo-granulation. In the secondary mixer, the total amount of coke (in case that no coke is added in the primary mixer) or the remaining amount of coke is added. When the coke breeze is added in the secondary mixer, the water is allowed to be contained therein in an amount which is necessary for the fine powders in the coke breeze to become granules or pellets in the mixer. This range of water may vary with the particle size of the coke and the porosity thereof, but should preferably be 5 - 20% for the following reason.

The saturated water value in the coke breeze is about 25 to 35%, of which about 20% is that necessary for filling the pores. The water value required for the pseudo-granulation can thus be calculated as follows:

$$\{(25 \text{ to } 35) - 20\} \times 0.5 + 20 = 22.5 \text{ to } 27.5$$

In the above formula, the figure 0.5 means that about 50% may contribute to the pseudo-granulation.

However, by strengthening the rolling, about 5%, and by using also a hydrophilic binder (hereinafter described), further 13% can be decreased, so that it is sufficient to include the water value in an amount of 5 to 20%. The reason why the upper limit of the coke in the primary mixer should be 70% is that as shown in FIG. 1(a), when the ratio of addition of coke in the primary mixer is more than 70%, the productivity will be lowered rapidly.

By doing this, the pseudo-granulation of the coke, that is, the sticking of the coke breeze particles to the coarse coke particles or the aggregation of the coke breeze particles per se, is carried out in the secondary mixer, whereby each pseudo coke particles may have a relatively uniform velocity of combustion.

In order to promote further the above mentioned effect, it is effective to carry out the following method.

In the secondary mixer, a hydrophilic binder is added together with the coke breeze and water. If necessary, in a separate mixer or pelletizer, etc., they are subjected to the preliminary pseudo-granulation and thereafter added to the secondary mixer.

What is meant by the hydrophilic binder used in this specification is a substance which functions to allow the materials for sintering to stick to each other so that the granulation or pelletizing may be promoted. It can be substituted by one of the materials for sintering such as quicklime. The binder itself has no limitation with respect to its physical and chemical properties, and may be solid or liquid, etc. The preferable embodiments of the binder is (1) quicklime, slaked lime, various cement, dust produced from converter, bentonite, or other non-organic substance; (2) natural of synthetic nonionic, anionic and cationic high moleculer coagulant such as (a) natural polyalcohol such as starch, etc., (b) gelatin and CMC alkaline or ammonium salt of alginic acid, (c) polyacrylamides such as copolymer of acrylamide and acrylic acid, partial hydrolysate salt of polyacrylamide, copolymer of acrylamide and maleic acid, etc., (d) polyethylene amine derivatives, (e) polyethylene-amino-triazole derivatives, (f) acetic salt of polythiourea, (g) water-soluble aniline resin acetates, etc. in single form or in admixture, etc.

The amount of the binder to be added in said first aspect of the invention is equal to or less than the amount of coke. This is partly because of economy and partly because of consideration of effect upon the inflammability of coke and limitation of generation of harmful gas.

By doing this, each particle of coke can be kept under inflammable condition as the pseudo-granulation of the coke breeze proceeds, whereby the uniform combustion can be maintained. As a result, the velocity of the coke can be promoted without lowering the sintering ability such as yield, strength, etc. of the product and thereby the conversion rate to NOx can be lowered.

According to the second aspect of this method, there is provided a method for the preliminary treatment of materials for sintering having a first step of mixing, moisture-adjusting and pelletizing the materials for sintering with or without addition of a part of the solid carbon to be added thereto and a second step of mixing, moisture-adjusting and pelletizing the resulting product of the first step with the addition of the remaining part of said solid carbon thereto, which comprises adding a hydrophilic binder in said first step.

Figure 4:
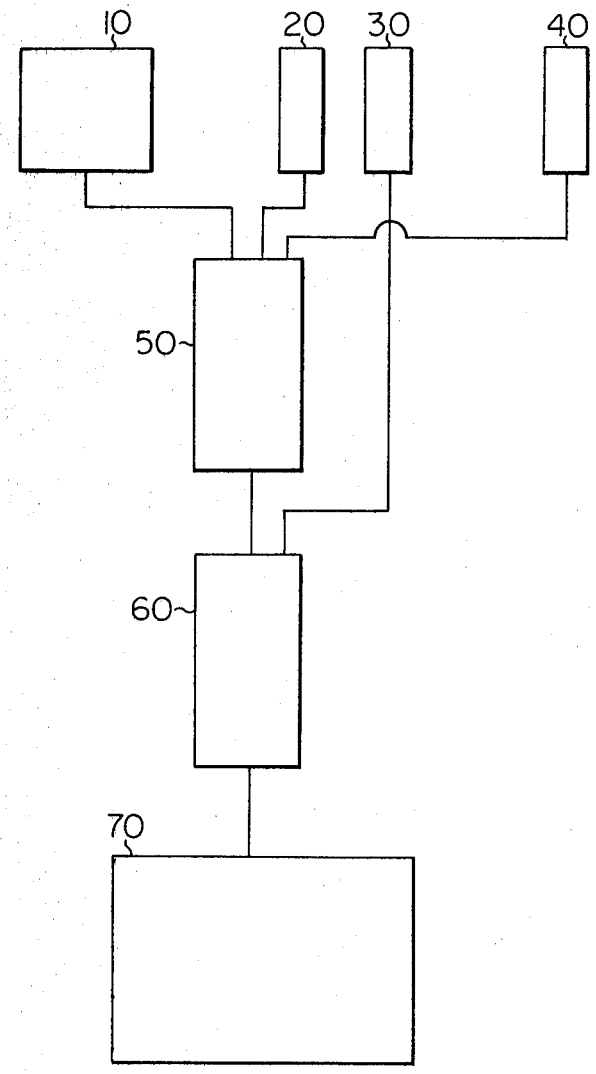

In FIG. 4, there is shown a flow sheet illustrating one embodiment of this second aspect of this method. Usually, the materials for sintering 10 and the coke breeze 20 are charged into a mixer 50 where they are mixed, moisture-adjusted and pelletized. Thereafter they are passed to a sintering machine 70.

When the coke-divided-addition method is carried out, the coke breeze to be added to the materials 10 are divided into 20 and 30, from which it is charged into the primary mixer 50 and the secondary mixer 60, respectively.

According to the practice of this invention, a binder 40 is charged into the primary mixer 50, in addition to the divided addition of the coke breeze.

Means to add the binder should preferably be one which has good workability and low cost. By charging the total amount of said binder to the primary mixer 50, the object of decreasing NOx can effectively be accomplished.

According to the third aspect of this method, there is provided a method for the preliminary treatment of materials for sintering having a first step of mixing, moisture-adjusting and pelletizing the materials for sintering with or without addition of a part of the solid carbon to be added thereto and a second step of mixing, moisture-adjusting and pelletizing the resulting product of the first step with the addition of the remaining part of said solid carbon thereto, which comprises adding a hydrophilic binder in said first step and also in said second step.

As for the addition of the binder, the total amount of the binder can be added to the first step in the coke-devided-addition method as the above mentioned second aspect. It is economically effective but it does not always exert a full advantage of the binder since the pelletizing proceeds only in the first step. The similar disadvantage will occur when the binder is added only to the second step.

As in the third aspect, when the binder is added dividedly to the first step and to the second step, a more uniform and complete pelletizing or granulation is made possible by adjusting the degree of progress of pelletizing in the first step and the second step.

Figure 5:
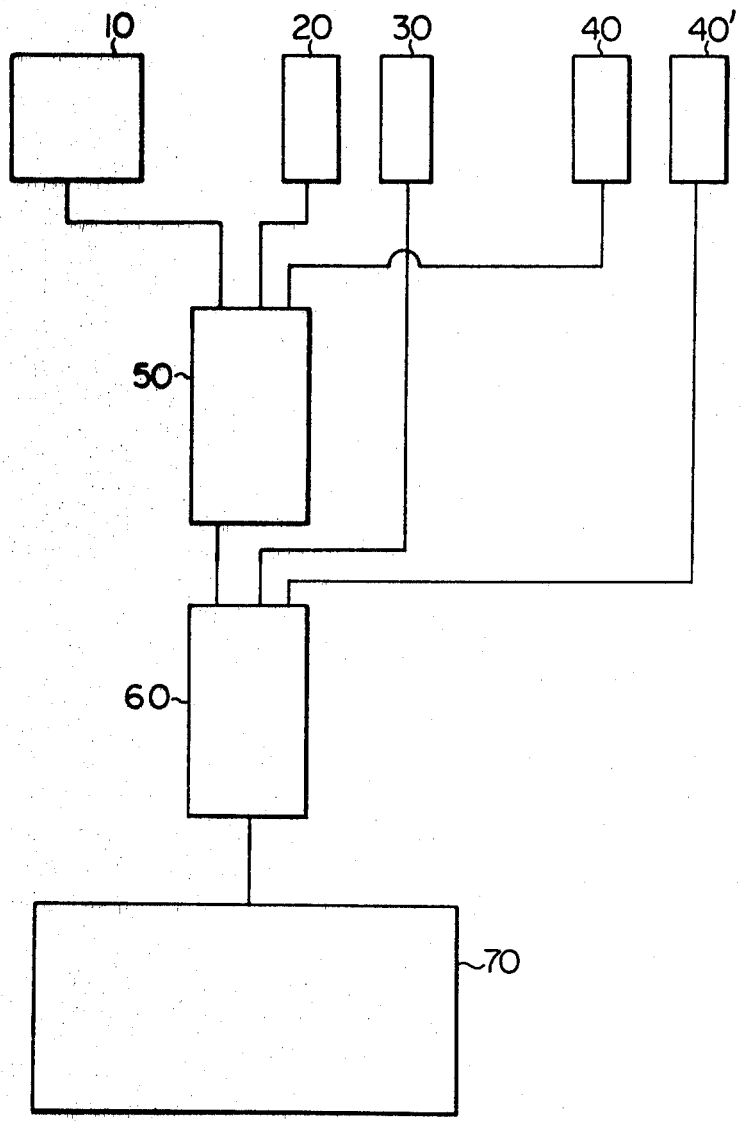

One example of the third aspect of this method is described with respect to FIG. 5.

As shown in FIG. 5, usually the materials for sintering 10 and the coke breeze 20 are charged into a mixer 50 where they are mixed, moisture-adjusted and pelletized. Thereafter they are passed to a sintering machine 70.

When the coke-divided-addition method is carried out, the coke breeze to be added to the materials 10 are divided into 20 and 30, from which it is charged into the primary mixer 50 and the secondary mixer 60 respectively.

According to the practice of this invention, a binder 40 and 40' are charged into the primary mixer 50 and the secondary mixer 60, respectively or dividedly, in addition to the divided addition of the coke breeze.

Preferable examples of the method of this invention for accomplishing the first object of the invention are shown below.

The effective area of the test plant is 170 $m^2$, and the step is carried out as shown in FIG. 2, wherein the mixing time in the primary drum mixer 3 is six minutes and that in the secondary drum mixer 4 is three minutes.

The mini-pellet used in this test plant is as follows:

(a) Materials for Mini-pellet and Water value contained therein

| | Mixing % | Water % |
|---|---|---|
| Sintering dust and blast furnace dust | 22% | 0% |
| Converter dust | 12% | 25% |
| Blast furnace secondary ash | 8% | 30% |
| Recovered special fine | 58% | 8% |
| Average | | 9.1% |

The word "Recovered special fine" means a fine powdery magnetite obtained by copper ore dressing in a Kamaishi Mine in Japan. It contains about 62% of iron value. To this mini-pellet, 3.0% bentonite is added.

(b) Particle size of Mini-pellet material

| Range of particle size | +48 mesh | 48 to 100 | 100 to 150 | 150 to 200 | 200 to 250 | 250 to 325 | −325 |
|---|---|---|---|---|---|---|---|
| Distribution of particle size % | 1.1 | 10.5 | 12.1 | 9.6 | 6.2 | 11.8 | 48.9 |

(c) Analysis of Mini-pellet product

| Component | T. Fe | $SiO_2$ | $Al_2O_3$ | CaO | MgO | Mn | Fuel carbon |
|---|---|---|---|---|---|---|---|
| % | 55.2 | 6.3 | 3.4 | 9.25 | 0.81 | 0.4 | 2.2 |

The mini-pellet is obtained by granulating the materials in the known inclined rotating disc in the production rate of 20 to 25 ton/hour. The particle size of the mini-pellet product is 1 to 7 mm for 80% in average, those more than 7 mm for 15% and those less than 1 mm for 5%. The breakdown strength is, in average, 0.3 kg/piece for 4 mm particle and the water value is, in average, 10.0%.

Under the above condition, Examples A and B of this invention using mini-pellet are shown below. As a control for comparison with the method of this invention, Example C is also shown which is the coke-divided-addition method without the use of the mini-pellet. Moreover, Example D is shown which uses the mini-pellet but does not use the coke-divided-addition method. Instead, it uses a known method of adding the total amount of coke in the primary drum mixer 3.

EXAMPLE A

In this example, a relatively finer powdery materials are used. The mixing ratio of the mini-pellet to the pure materials is 7.1% and the mini-pellet is added just before the secondary drum mixer as shown in FIG. 2.

The mixing ratio of the pure materials is shown in the following table, in which Kamaishi fine ore is a magnetite ore containing 80% of fine powder of 250 μ or less.

| Ore | Mixing ratio % |
|---|---|
| Kamaishai fine ore | 5.4 |
| Imported fine ore | 60.9 |
| Lime powder | 13.9 |
| Dolomite | 3.6 |
| Serpentine powder | 1.0 |
| Scale powder | 3.6 |
| Silica powder | 2.5 |
| Mini-pellet | 7.1 |
| Total | 100 |

Those obtained by adding the return fine and coke breeze to the above pure materials are called mixing materials. The particle size of the mixing materials is as indicated below.

| Range of particle size | +1000μ | 1000μ to 500μ | 500μ to 250μ | 250μ to 125μ | −125μ |
|---|---|---|---|---|---|
| Distribution of particle size % | 47.5 | 9.6 | 8.9 | 11.5 | 22.5 |

In the flow sheet of FIG. 2, the ratio of the coke breeze added before the primary drum mixer 3 is 50%, and the rest is added before the secondary drum mixer 4. The result is as follows:

| | |
|---|---|
| Rate of production ($t/d/m^2$) | 39.9 |
| Yield of product (%) | 72.3 |
| Drop strength (%) | 84.3 |

The productivity is thus maintained at a high level shown above.

EXAMPLE B

This example shows the use of very fine powdery materials. The rate of mixing of the mini-pellet to the pure materials is 8.9 and it is added in the same manner as in Example A.

| Ore | Mixing ratio % |
|---|---|
| Kamaishi fine ore | 12.5 |
| Imported fine ore | 55.4 |
| Lime powder | 16.1 |
| Serpentine | 2.7 |
| Silica | 1.5 |
| Mini-pellet | 8.9 |
| Total | 100 |

The particle size of the mixing materials is very small as shown below.

| Range of particle size | +1000μ | 1000μ to 500μ | 500μ to 250μ | 250μ to 125μ | 125μ |
|---|---|---|---|---|---|
| Distribution of particle size (%) | 40.2 | 14.2 | 6.6 | 18.4 | 20.6 |

The way of addition of the coke breeze is same as in Example A. The 50% of coke breeze is added before the primary drum mixer 3 and the remaining coke breeze is added just before the secondary drum mixer 4. The result is as follows:

| | |
|---|---|
| Rate of production ($t/d/m^2$) | 36.4 |
| Yield of product (%) | 72.0 |
| Drop strength (%) | 83.1 |

The rate of production is lower than that of Example A but is still in the high level.

EXAMPLE C

In this example, the mini-pellet is not used, and instead the materials for the mini-pellet are added before the primary drum mixer as shown in FIG. 2. The ratio of the pure materials is shown below, which is much the same as Example B.

| Ore | Mixing ratio % |
|---|---|
| Kamaishi fine ore | 13.2 |
| Imported fine ore | 55.0 |
| Lime powder | 15.7 |
| Serpentine powder | 2.5 |
| Silica powder | 1.7 |
| Mini-pellet materials | 9.0 |
| Total | 100 |

The particle size of the mixing materials in this case is as follows:

| Range of particle size % | +1000μ | 1000μ to 500μ | 500μ to 250μ | 250μ to 125μ | −125μ |
|---|---|---|---|---|---|
| Distribution of particle size | 40.0 | 10.2 | 8.4 | 16.2 | 25.0 |

The way of addition of the coke breeze is same as in Example A or B. The result is as follows:

| | |
|---|---|
| Productivity (t/d/m²) | 33.4 |
| Yield of product (%) | 72.7 |
| Drop strength (%) | 83.9 |

EXAMPLE D

In this example, the very fine materials are used but the coke-divided-addition method is not sued. Instead, the whole amount of coke is added just before the primary mixer 3 and the mixing ratio of the mini-pellet in the pure materials is 6.5%.

| Ore | Mixing ratio % |
|---|---|
| Kamaishi fine ore | 18.1 |
| Imported fine ore | 55.5 |
| Lime powder | 15.4 |
| Serpentine powder | 1.5 |
| Mini-pellet | 6.5 |
| Others | 4.0 |
| Total | 100 |

The particle size of the mixing materials is shown below.

| Range of particle size | +1000μ | 1000μ to 500μ | 500μ to 250μ | 250μ to 125μ | −125μ |
|---|---|---|---|---|---|
| Distribution of particle size (%) | 43.3 | 10.5 | 8.9 | 7.2 | 29.2 |

The result is shown below, from which it is seen that the productivity has lowered.

| | |
|---|---|
| Productivity (t/d/m²) | 31.7 |
| Yield of product (%) | 71.5 |
| Drop strength (%) | 87.4 |

As described above, the advantage of this invention is clearly shown by comparing Example B with Example C, though the particle size of Example C is smaller than that of Example B. In other words, the advantage of this invention that a great amount of mini-pellet is added to the coke-divided addition method is demonstrated above. Moreover, when Example B is compared with Example D, it is seen that a mere addition of the mini-pellet without the use of the coke-divided-addition method can not exert a satisfactory result. In passing, in the practice of the coke-divided-addition method, even if the amount of the coke to be added before the primary mixer 3 is caused to change from 20% to 50%, the productivity does not change very much. When the fine powdery coke is used, our experiments show that the amount should preferably be about 50%.

From the foregoing examples it is seen that the productivity can be remarkably improved particularly when the fine powdery materials are used. This means that, by the use of the method of this invention, the materials containing a lot of fine powders which have heretofore been hardly utilized can be used. Its economical advantage is thus very significant in view of the exhaustion of the natural resources at present. In the practice of the method of this invention, the coke-divided-addition method is utilized. Consequently, the same phenomenon as that of the method is shown in the course of sintering, and a part of NOx is reduced and decomposed by a reducing atmosphere in the rear part of the combustion zone. Accordingly, this method of invention also exerts an effect of decreasing NOx to a satisfactory effect, which will contribute to the improvement of counter-measure to the public pollution.

The following examples illustrate the first aspect of the method of this invention for accomplishing the second object thereof.

EXAMPLE 1

The materials for sintering and the coke having the distribution of the particle size as shown in Table 1 are used. They are subjected to the primary mixing and the secondary mixing in a drum mixer of 1000 mmϕ × 500 mml.

The sintering test as shown in Table 2 is effected. The result is shown in Table 3. From this, it is seen that the rate of conversion to NOx is decreased from 40% to 25% and 37.5%.

Table 1

| | Distribution of the particle size of the materials and the coke | | | | | | |
|---|---|---|---|---|---|---|---|
| | >5mm | 5 to 2 | 2 to 1 | 1 to 0.5 | 0.5 to 0.25 | 0.25 to 0.125 | <0.125 |
| Ores | 13.3% | 24.6% | 12.9% | 9.6% | 12.4% | 14.9% | 12.3% |
| Coke | 0.6% | 17.7% | 15.6% | 16.0% | 16.3% | 14.3% | 19.5% |

Table 2

| | | Condition of addition of coke | | |
|---|---|---|---|---|
| | | 1 | 2 | 3 |
| Rate of addition of coke (%) | Primary | 4.0 | 0.5 | 0.5 |
| | Secondary | 0 | 3.5 | 3.5 |
| Water value in coke (%) | Primary | 0.5 | 0.5 | 0.5 |
| | Secondary | — | 10.0 | 10.0 |
| Rate of addition of quicklime | | 0 | 0 | 3.0 |

Table 3

| | Result of sintering | | |
|---|---|---|---|
| | 1 | 2 | 3 |
| Time of sintering (min.) | 27.5 | 25.4 | 24.1 |
| Yield of product (%) | 73.2 | 71.2 | 71.3 |
| Productivity (T/D/m²) | 31.5 | 33.2 | 34.1 |
| NOx conversion rate (%) | 40 | 30 | 25 |

EXAMPLE 2

The materials and the coke having the particle size shown in Table 4 are used. They are subjected to the mixing, moisture-adjustment and pelletizing in two drum mixers of 4 mϕ × 16 ml and 3.2 mϕ × 12.8 ml under the condition shown in Table 5. The resulting materials are sintered in a practical sintering machine having the sintering area of 170 m².

The result is shown in Table 6.

Table 4

| | Distribution of the particle size of the materials and the coke | | | | |
|---|---|---|---|---|---|
| | +5mm | 5 to 1 mm | 1 to 0.5 mm | 0.5 to 0.125 mm | −0.125mm |
| Mixed materials | 4.5% | 39.3% | 13.0% | 18.4% | 24.8% |
| Coke | +3mm | 15.8% | −0.125mm | | 19.3% |

Table 5

| | | Condition of addition of coke | | |
|---|---|---|---|---|
| | | 1 | 2 | 3 |
| Rate of addition of coke (%) | Primary | 3.2 | 1.75 | 0.68 |
| | Secondary | 0 | 1.75 | 2.72 |
| Water value in coke (%) | Primary | 5 | 5 | 5 |
| | Secondary | 11 | 11 | 11 |

Table 6

| | Result of sintering | | |
|---|---|---|---|
| | 1 | 2 | 3 |
| Productivity (T/D/m$^2$) | 31.7 | 33.4 | 37.3 |
| Yield of product (%) | 73.4 | 72.6 | 75.5 |
| Fire velocity (mm/min) | 19.4 | 20.4 | 20.6 |
| NOx conversion rate (%) | 48 | 41 | 38 |

The following example illustrates the second aspect of the invention for accomplishing the second object thereof.

EXAMPLE

Using a test sintering machine and the materials for sintering shown in Table 7, a test for comparing the method of this invention with the prior art (coke breeze-divided-addition method) is conducted. The result is shown in Table 8. The coke breeze is added in the first step in an amount of 20% of the total and in the second step in an amount of 80% of the total. As the binder, the quicklime is used in an amount of 1.5% in the materials for sintering. It is clear from the result of the test that according to the method of this invention the rate of conversion to NOx can be largely decreased as compared with the prior art.

Table 7

| | Mixing ratio % |
|---|---|
| Brazil S.F.B. | 25.0 |
| Brazile crushed powder | 12.0 |
| Hamersley | 13.2 |
| Lime stone | 6.4 |
| Scale | 3.1 |
| Iron sand | 2.1 |
| Serpentine | 1.1 |
| Soft silica | 2.0 |
| Mn powder | 0.4 |
| Return fine | 29.7 |
| Coke breeze | 3.5 |
| Quicklime (binder) | 1.5 |

Table 8

| Quicklime | not charged | charged in the fore step |
|---|---|---|
| NOx conversion (%) | 39.5 | 29.7 |

The following example illustrates the third aspect of the invention for accomplishing the second object thereof.

EXAMPLE

Using a test sintering machine and the materials for sintering shown in Table 7, a test for comparing the method of this invention with the method of charging the binder either in the first step or in the second step is conducted. The result is shown in Table 9. The coke-divided-addition method is carried out, wherein the coke breeze is added in an amount of 20% of the total in the first step, and 80% in the second step. As the binder, the quicklime is used in an amount of 1.5% in the material for sintering. It is clear from the result of the test that according to the method of this invention the rate of convertion to NOx can be largely decreased as compared with the other methods.

Table 9

| Quicklime | Prior art | Comparative method | | Method of this invention |
|---|---|---|---|---|
| | Not charged | Charged only in first step | Charged only in second step | Charged in first step and in second step dividedly |
| NOx conversion rate (%) | 39.5 | 29.7 | 30.8 | 26.2 |

I claim:

1. In a method for preliminarily treating sintering materials containing fine powder of a particle size of less than 125$\mu$ in the range of 15% to 35% comprising adding in a first treatment step solid carbon to a mix component consisting of powdery or fine powdery iron ore, fluxing materials, dust recovered from steel-making operations and return fines from a sintering operation and then mixing, effecting moisture adjustment, and subjecting said component to a pseudo granule formation operation, and then adding in a second treatment step solid carbon to the material resulting from said first step and thereafter effecting mixing, moisture adjustment and pseudo granule formation operations, the improvement wherein mini-pellets at least 75% of which are of a size of 1 to 7 mm are added in the second step to said first step material in an amount of 3% to 15% by weight of the materials present other than coke, return fines and hearth layer.

2. The method according to claim 1 in which the solid carbon is a coke or coke breeze.

3. The method according to claim 1 in which the mini-pellet contains 1 to 5% by weight of a hydrophilic binder.

4. The method according to claim 1 in which in the first step the solid carbon is added to the sintering materials in an amount of less than 70% of the solid carbon added in both steps, and in said second step the remaining solid carbon containing water, or a hydrophilic binder is added to the resulting material of the first step.

5. The method according to claim 4 in which the water is contained in the solid carbon in an amount of 5% to 20% by weight of the solid carbon.

6. The method according to claim 1 in which a hydrophilic binder is added in the second step.

7. The method according to claim 1 in which a hydrophilic binder is added in both said first and second steps.

8. The method according to claim 6 in which the solid carbon is a coke or coke breeze.

9. The method according to claim 7 in which the solid carbon is a coke or coke breeze.

10. The method according to claim 4 in which the hydrophilic binder is added in an amount equal to or less than the amount of the solid carbon.

11. In a method for preliminarily treating sintering materials containing fine powder of a particle size of less than 125μ in the range 15% to 35% the steps comprising subjecting in a first treatment step a mix component consisting of powdery or fine powdery iron ore, fluxing materials, dust recovered from steel-making operations and return fines from a sintering operation to mixing, moisture adjustment and pseudo granule formation operations, and in a second treatment step adding to the material resulting from said first step solid carbon containing water or a hydrophilic binder, and mini-pellets at least 75% of which are of a size of 1 to 7 mm the mini-pellets being added in an amount of 3% to 15% by weight of the materials present other than coke, return fines and hearth layer, and thereafter effecting in said second step, mixing, moisture adjustment and pseudo granule formation operations.

12. The method according to claim 11 in which water is contained in the solid carbon in an amount of 5% to 20% by weight of the solid carbon.

13. The method according to claim 11 in which the hydrophilic binder is added in an amount equal to or less than the amount of the solid carbon.

* * * * *